US005306158A

United States Patent [19]

Endo et al.

[11] Patent Number: 5,306,158

[45] Date of Patent: Apr. 26, 1994

[54] CONNECTOR FOR CIRCUIT BOARD

[75] Inventors: Takayoshi Endo; Shigemitsu Inaba; Satoshi Yamada, all of Shizuoka, Japan

[73] Assignee: Yazaki Corporation, Japan

[21] Appl. No.: 45,195

[22] Filed: Apr. 13, 1993

[30] Foreign Application Priority Data

Apr. 13, 1992 [JP] Japan ..... 4-23261

[51] Int. Cl.[5] ..... H01R 9/09

[52] U.S. Cl. ..... 439/59; 439/62

[58] Field of Search ..... 439/59, 62, 64, 76

[56] References Cited

U.S. PATENT DOCUMENTS 3,706,065 12/1972 Knitter et al. ..... 439/59 X 5,156,553 10/1992 Katumata et al. ..... 439/62

FOREIGN PATENT DOCUMENTS 1161583 11/1983 Japan .

*Primary Examiner*—Eugene F. Desmond

*Attorney, Agent, or Firm*—Venable, Baetjer, Howard & Civiletti

[57] ABSTRACT

A connector for circuit board has a guide case provided on the base wall thereof, which has openings for exposing terminal conductors of a circuit board inserted therein and guide ribs for leading insertion of spring terminal of another connector and of which the edge portion is tapered. Thereby the terminal connecting portion of the circuit board may be assembled without a shift in position and it is possible to keep a secure electrical connection of the two connectors.

14 Claims, 5 Drawing Sheets

CONNECTOR FOR CIRCUIT BOARD

BACKGROUND OF THE INVENTION

1. Field of the Invention

The present invention relates to connectors for circuit board and, more particularly, relates to a connector for circuit board capable of assembling the terminal connecting portion of a circuit board in a stable manner without a shift in position thereof and also capable of being securely connected to spring terminal with which it is to be mated.

2. Description of the Prior Art

A conventional connector for circuit board is formed into a box-like shape and a slit-like opening is provided on the base wall thereof, so that a flat plate-like terminal connecting portion continued from a circuit board is inserted into such an opening. Provided in parallel on the terminal connecting portion are a plurality of conductor terminals which are continued from a circuit conductor printed on the surface of the circuit board. A slit-like notch corresponding to the flat plate-like terminal connecting portion is provided on a connector with which the circuit board connector is to be mated and, in the notch portion, a spring terminal having resilient contacting pieces which are to contact the conductor terminals of the terminal connecting portion. By fitting these two connectors together, the terminal connecting portion on the circuit board side and the spring terminal are brought into contact with each other to be electrically connected. Such connector for circuit board has been disclosed in Japanese Utility Model Laid-Open Publication No.JP-U-1-161583(1989).

In the conventional circuit board connector, however, the terminal connecting portion tends to be easily shifted vertically and/or horizontally in position within the connector housing, causing such disadvantages as the occurrence of a bad contact with the spring terminal to be mated therewith or, in worst case, a short circuit. Further, there is also another problem that a large inserting force is necessary when the edge at the distal end of the terminal connecting portion and the spring terminal are abutted against each other, whereby the conductor terminals on the terminal connecting portion may be turned over.

SUMMARY OF THE INVENTION

In view of the above described problems, it is an object of the present invention to provide a connector for circuit board by which a secure electrical connection may be achieved without causing a shift in position of the terminal connecting portion of the circuit board and, at the same time, a smooth insertion of the connector is possible and the conductor terminal thereof is not caused to be turned over.

To this end, a connector for circuit board is provided in accordance with the present invention, formed of a plastic material into a box-like shape having a base wall at a midway point thereof perpendicularly to the direction along which terminals are to be connected, and thereby electrically connecting terminal conductors of the circuit board and spring terminals on the side to be mated therewith, wherein the connector has a guide case provided on the base wall, having openings for causing the terminal conductors of the circuit board to be exposed and guide ribs for guiding insertion of the spring terminal on the side to be mated therewith. It is preferable that the guide case provided on the connector's base wall tapers toward the spring terminal, at the edge portion thereof toward its distal end from the openings for exposing the terminal conductor.

According to such a connector for circuit board of the present invention, when inserted into the guide case from the openings of the connector housing, the circuit board is stably positioned and vertical and horizontal shift thereof is prevented. Further, the spring terminal on the side to be mated therewith is led to the terminal conductor exposing openings as it is guided by the guide ribs of the guide case and at the same time its shift in position with respect to a left and right direction thereof is prevented by the guide case, thereby it may be kept in a secure electrical contact with the terminal conductor. In addition, since the edge portion forming the free end of the guide case tapers toward the direction facing the spring terminal, the spring terminal may be smoothly introduced without causing an increase in the inserting force and/or turning over of the terminal conductor.

The objects, advantages and novel characteristics of the present invention will now be described with reference to the accompanying drawings.

DESCRIPTION OF THE PREFERRED EMBODIMENT

Figure 1:
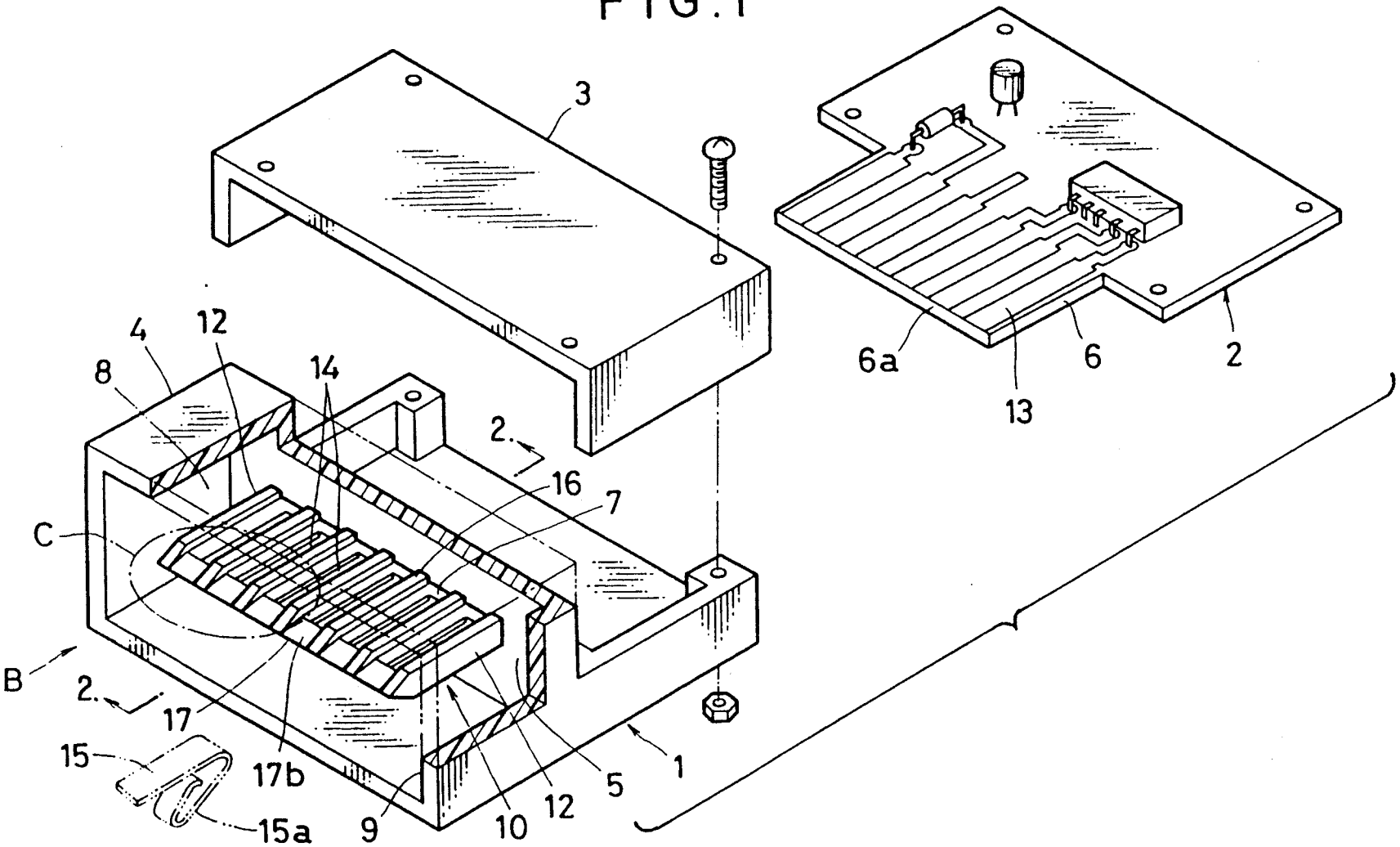
FIG. 1 is an exploded perspective view showing an embodiment of the circuit board connector according to the present invention.

As shown in FIG. 1, a connector 1 for circuit board according to the present invention is formed into a box-like shape of a plastic material and includes: a circuit board 2 to be inserted into a connector housing body 4; and a cover 3 by which the circuit board 2 is fixed to the housing body 4 with a setscrew. On a base wall 5 provided at some midway portion of the housing body 4, an opening 7 into which a terminal connecting portion 6 of the circuit board 2 is inserted is provided and a guide case 10 for inserting the terminal connecting portion 6 is raised integrally from the base wall 5 toward a front end opening 9 of a connector fitting chamber 8.

Figure 2:
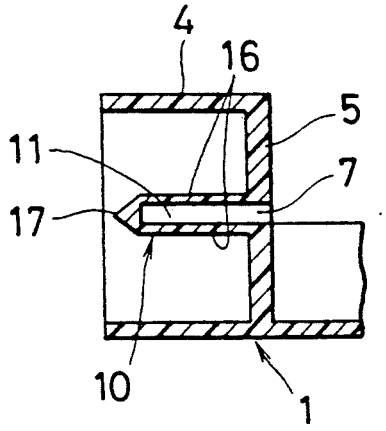
FIG. 2 is a sectional view taken along A—A of FIG. 1.
Figure 3:
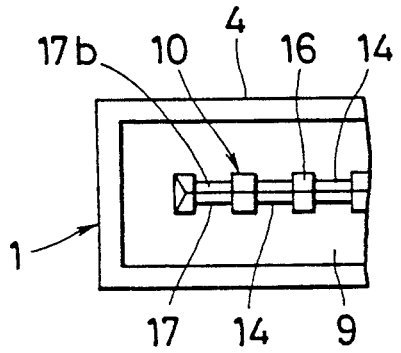
FIG. 3 is a front view as seen along the arrow B of FIG. 1.

The guide case 10, as shown in FIG. 2, has a hollow 11 continuing from the inserting opening 7, which is substantially identical in its width and height with the circuit board terminal connecting portion 6 and it has a plurality of exposing openings 14 corresponding to printed terminal conductors 13 of the terminal connecting portion 6, provided in parallel on both the upper and lower surfaces between the two side walls 12,12 as shown in FIG. 1. In addition, it has guide ribs 16 provided thereon for separating the adjacent exposing openings from each other. These guide ribs are provided to guide a spring terminal 15 of a connector to be mated therewith. On an end linking portion 17 which comprises the free end of the guide case 10 and as shown in FIGS. 3 and 4 links the guide ribs 16 across the two side walls 12,12, an abutting surface 17*a* for abutting against the distal end 6*a* of the terminal connecting portion is formed internally of the linking portion 17 while the outside of the linking portion 17 tapers to form a sloped guide surface 17*b* which corresponds to the spring terminal 15 of the connector to be mated therewith.

Figure 4:
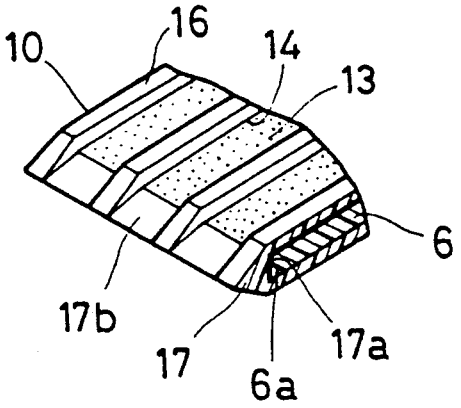
FIG. 4 is an enlarged perspective view of the portion indicated by C showing the state after inserting the terminal conductor of the circuit board into the guide case of the connector of FIG. 1.

The terminal connecting portion 6 of the circuit board is stably inserted, as shown in FIG. 4, into the guide case 10 without a play in vertical and horizontal direction thereof so as to expose the terminal conductors 13 from the exposing openings 14, and the distal end 6*a* of the terminal connecting portion is caused to abut against the abutting surface 17*a* so that the surfaces of the terminal conductors 13 are crossed thereat in a manner continuing to the sloped guide surface 17*b*. In addition to the fact as a matter of course that the terminal connecting portion 6 is stably positioned within the guide case 10, a resilient contacting piece 15*a* of the spring terminal 15 of the connector to be mated therewith is thus smoothly guided to the exposing opening 14 while sliding on the sloped guide surface 17*b* and is positioned by the guide ribs 16 without play in the left and right direction thereof. Therefore, a secure electrical connection is possible by a small inserting force on the other connector.

Figure 5:
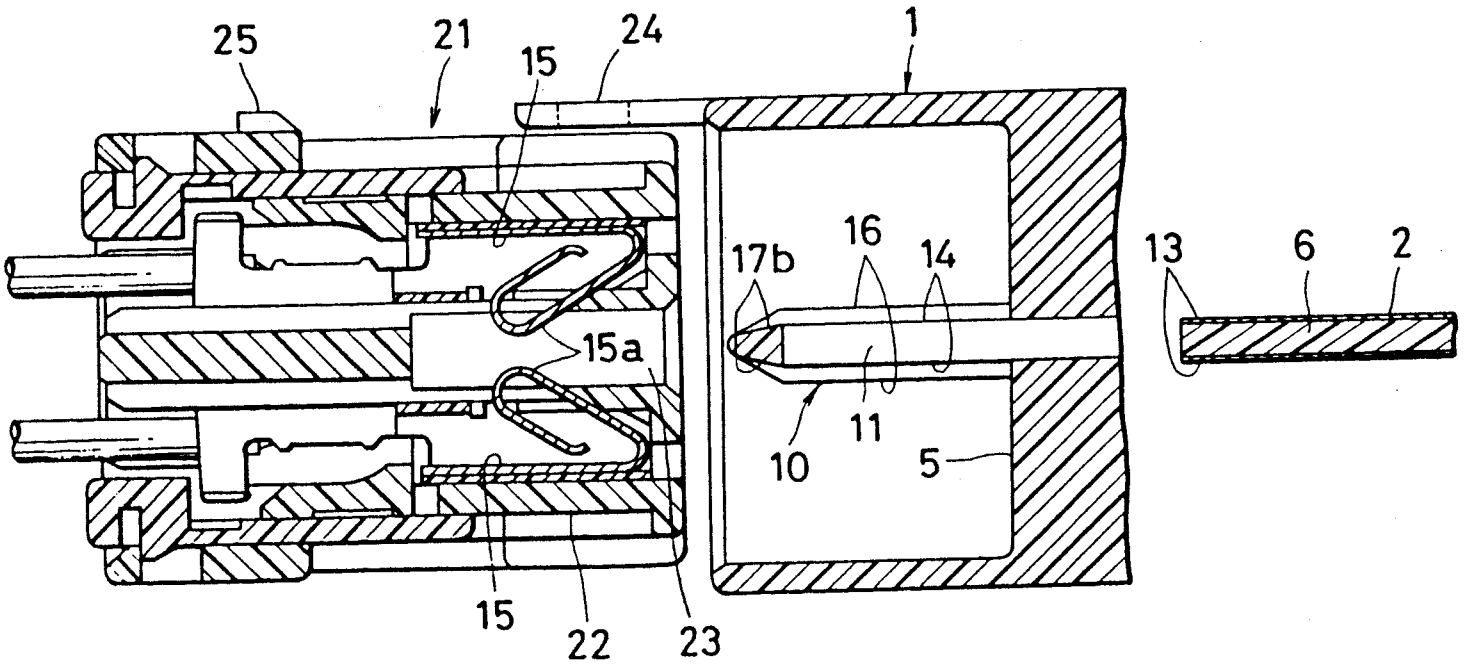
FIG. 5 is a longitudinal section showing the state before fitting the connector with spring terminal to the circuit board connector of FIG. 1.
Figure 6:
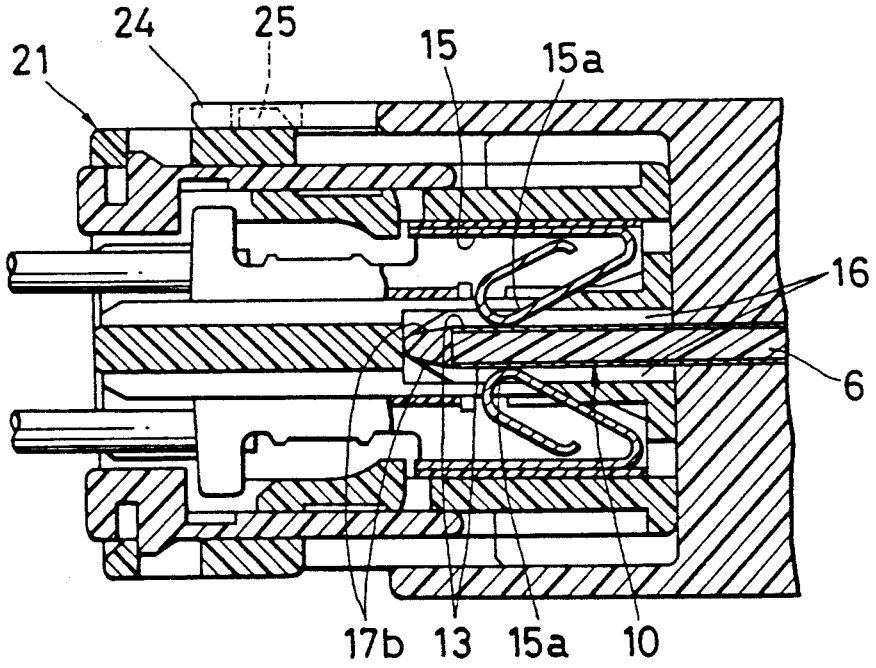
FIG. 6 is a longitudinal section showing the state after fitting to each other the two connectors of FIG. 5.

Shown in FIGS. 5 and 6 is the course of connecting the circuit board connector 1 to the other connector 21. The other connector 21 has a pair of spring terminals 15 corresponding to the terminal connecting portion 6 of the circuit board 2. A notch 23 for insertion corresponding to the guide case 10 is provided on a housing 22 of the other connector 21, resilient contacting pieces 15*a* of the pair of spring terminals 15 being projected within the notch 23 in a manner opposing to each other. Further, a lock projection 25 to be engaged with a lock arm 24 provided on the circuit board connector 1 is provided on the outer wall of the housing 22. As the two connectors fitted to each other, the resilient contacting piece 15*a* of the spring terminal 15 is caused to slide as shown in FIG. 6 on the surface of the terminal conductor 13 exposed at the exposing opening 14, along the sloped guide surface 17*b* at the distal end of the guide case 10, so that the lock arm 24 and the lock projection 25 are engaged with each other and the two connectors are completely fitted to each other. Here, as a matter of course, the resilient contacting piece 15*a* is positioned by the guide ribs 16 so as to prevent a short circuit with an adjacent terminal conductor 13.

Figure 7:
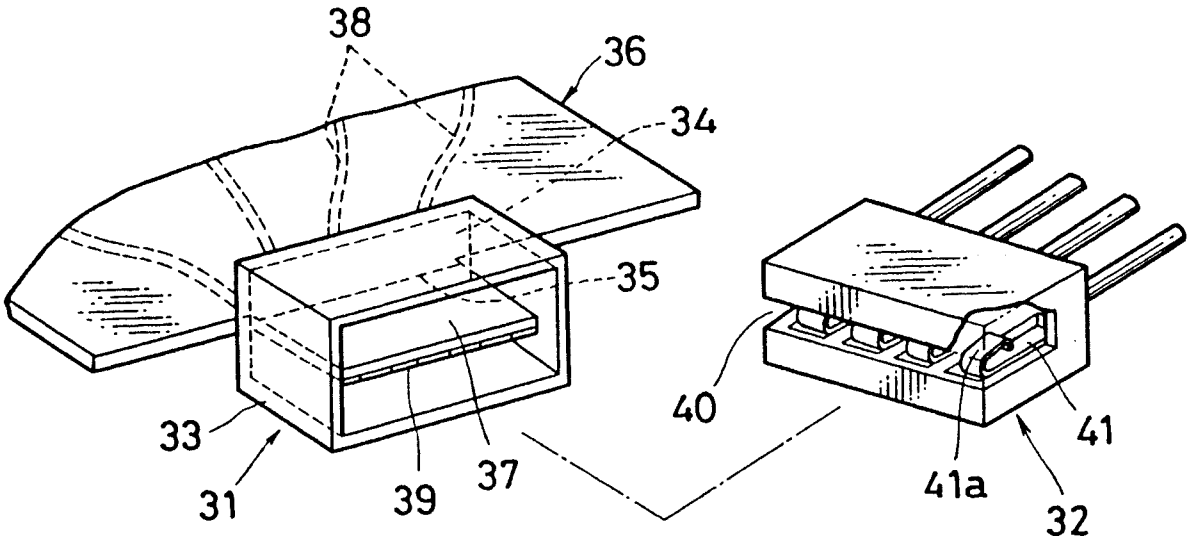
FIG. 7 PRIOR ART
FIG. 7 is an exploded perspective view of a conventional circuit board connector and another connector to be mated therewith.

In a conventional circuit board connector 31, as shown in FIG. 7, a terminal connecting portion 37 of a printed circuit board 36 is inserted from a slit-like opening 35 provided on a base wall 34 of a housing 33. A plurality of conductor terminals 39 continuing to circuit conductor 38 printed on the surface of the circuit board 36 are provided in parallel on the terminal connecting portion 37. Further, on a connector 32 with which the circuit board connector 31 is to be mated, a slit-like notch 40 corresponding to the terminal connecting portion 37 is provided, where spring terminals 41 having resilient contacting pieces 41*a* for contacting the conductor terminal 39 of the terminal connecting portion 37 are arranged internally thereon. When the two connectors 31 and 32 are fitted to each other, the terminal connecting portion 37 is brought into contact with the spring terminal 41 to effect an electrical connection thereof.

In such a conventional circuit board connector, however, the terminal connecting portion 37 tends to be easily shifted vertically and/or horizontally in position within the connector housing 33, causing such disadvantages as the occurrence of a bad contact with the spring terminal 41 to be mated therewith or, in worst case, a short circuit. Further, there is also another problem that a large inserting force is necessary when the edge at the distal end of the terminal connecting portion 37 and the spring terminal 41 are abutted against each other, whereby the conductor terminals 39 on the terminal connecting portion 37 may be turned over.

According to the connector for circuit board of the present invention, since the terminal connecting portion of a circuit board is positioned by a guide case provided on the connector housing, a shift in position vertically and/or horizontally thereof does not occur, eliminating the problems of a bad contact with the terminal of a connector to be mated therewith and of a short circuit. Further, since the terminal of the connector to be mated therewith is guided in a manner of sliding contact to the sloped guide portion of the tapered edge of the guide case, it may be smoothly inserted and connection by a small inserting force is possible. As a result, the possibility of turning over of the conductor terminal of the circuit board connector may also be eliminated.

Many different embodiments of the present invention may be constructed without departing from the spirit and scope of the present invention. It should be understood that the present invention is not limited to the specific embodiment described in this specification, and is only limited in the appended claims.

What is claimed is:

1. A circuit board connector for electrically connecting at least one terminal conductor of a circuit board to a respective spring terminal of a complementary connector with which the circuit board is to be mated, said circuit board connector comprising:

a connector housing body, said housing body including a base wall having an opening for receiving at least one terminal conductor of a circuit board; and a guide case connected to said base wall adjacent said opening of said base wall, said guide case having at least one slot for receiving the terminal conductor of the circuit board, at least one terminal-exposing opening for exposing the terminal conductor, and at least one guide rib for guiding the terminal conductor into electrical connection with a spring terminal of a complementary connector.

2. A circuit board connector according to claim 1, wherein said guide case has a tapered distal end.

3. A circuit board connector according to claim 1, wherein said guide case extends substaintially perpendicularly from said base wall.

4. A circuit connector according to claim 3, wherein said at least one rib extends substantially perpendicularly from said base wall adjacent to said at least one terminal-exposing opening of said guide case.

5. A circuit board connector according to claim 2, wherein said guide case has a tapered edge portion at a distal end thereof and said at elast one rib extends from said opening of said base wall to said tpaered edge portion.

6. A circuit board connector according to claim 1, wherein said guide case includes a plurality of said ribs and a plurality of said terminal-exposing openings, each said terminal-exposing opening being positioned between respective ones of said ribs.

7. A circuit board connector according to claim 6, wherein said ribs and said terminal-exposing openings of said guide case extend substantially perpendicularly from said base wall.

8. A circuit board connector according to claim7, wherein said guide case includes a tapered edge portion at a distal end thereof.

9. A circuit board connector according to claim 1, wherein said circuit board connector comprises a plastic material.

10. A circuit board connector according to claim 1, wherein said connector housing body includes a connector fitting chamber for receiving the complementary connector and into which said guide case extends.

11. A circuit board connector according to claim 1, wherein said guide case includes two side walls and upper and lower surface extending between said two side walls, said two side walls and said upper and lower surfaces extending substantially perpendicularly from said base wall.

12. A circuit board connector according to claim 11, wherein said guide case includes a plurality of said terminal-exposing openings, at least one of said terminal-exposing openings being provided in said upper surface of said guide case, and at least one of said terminal-exposing openings being provided in said lower surface of said guide case.

13. A circuit board connector according to claim 12, wherein said guide case includes a plurality of said ribs, at least one of said ribs being provided on said upper surface of said guide case, and at least one of said ribs being provided on said lower surface of said guide case.

14. A circuit board connector according to claim 11, wherein said guide case includes a tapered edge portion at a distal end of said guide case, said tapered edge portion extending between said side walls.

* * * * *